US007547235B2

(12) United States Patent
Hasid

(10) Patent No.: US 7,547,235 B2
(45) Date of Patent: Jun. 16, 2009

(54) MULTI-SOCKET ASSEMBLY

(76) Inventor: Noa Hasid, 36 Modi'yim St., Shoham (IL) 73142

( * ) Notice: Subject to any disclaimer, the term of this patent is extended or adjusted under 35 U.S.C. 154(b) by 0 days.

(21) Appl. No.: 10/587,211

(22) PCT Filed: Jan. 20, 2005

(86) PCT No.: PCT/IL2005/000071

§ 371 (c)(1),
(2), (4) Date: Jul. 25, 2006

(87) PCT Pub. No.: WO2005/071804

PCT Pub. Date: Aug. 4, 2005

(65) Prior Publication Data

US 2007/0155212 A1 Jul. 5, 2007

Related U.S. Application Data

(60) Provisional application No. 60/538,474, filed on Jan. 26, 2004.

(51) Int. Cl.
*H01R 33/94* (2006.01)

(52) U.S. Cl. ..... 439/652; 439/650; 439/590; 439/77

(58) Field of Classification Search ..... 439/652, 439/650, 590, 170, 77, 653
See application file for complete search history.

(56) References Cited

U.S. PATENT DOCUMENTS

| | | | | |
|---|---|---|---|---|
| 3,527,933 A | | 9/1970 | Thümmel | |
| 4,072,376 A | * | 2/1978 | Shannon | 439/590 |
| 5,788,521 A | * | 8/1998 | Milan | 439/214 |
| 5,902,148 A | * | 5/1999 | O'Rourke | 439/505 |

FOREIGN PATENT DOCUMENTS

| | | |
|---|---|---|
| DE | 92 12 997 | 12/1992 |
| DE | 297 05 946 | 6/1997 |
| DE | 101 39 202 | 3/2003 |
| EP | 1 139 512 | 10/2001 |
| GB | 2 350 493 | 11/2000 |
| WO | 03/105287 | 12/2003 |

* cited by examiner

*Primary Examiner*—Tho D Ta
*Assistant Examiner*—Travis Chambers
(74) *Attorney, Agent, or Firm*—The Nath Law Group; Jerald L. Meyer; Sungyeop Chung

(57) ABSTRACT

A multi-socket assembly comprising a plug unit operatively connected to at least one socket unit wherein the assembly is formed as an integral body comprising at least one suitable electrically insulating material that encapsulates the electrical connections between the plug unit and the at least one socket unit.

18 Claims, 5 Drawing Sheets

SECTION X-X

MULTI-SOCKET ASSEMBLY

This is a National Phase Application filed under 35 U.S.C. 371 of International Application No. PCT/IL2005/000071, filed on Jan. 20, 2005, claiming the benefit under 35 USC 119(e) of U.S. Provisional Patent Application No. 60/538,474, filed on Jan. 26, 2004, the entire content of each of which is hereby incorporated by reference in its entirety.

FIELD OF THE INVENTION

This invention relates to electrical multi-socket assemblies comprising a plurality of sockets, typically for use with alternating current (AC). In particular the invention is directed to such multi-socket assemblies that are constructed in an integral manner.

BACKGROUND OF THE INVENTION

The term "multi-socket assembly" is used herein to refer to electrical multi-socket assemblies, which generally comprise a main line entry and connecting means, also known as a "plug", for connection between the main line and the individual pin-holes in each socket. In a multi-socket assembly, typically, a plurality of sockets are arranged in series in a common box-like and rigid housing, and a flexible lead electrically connects the housing to the plug. Within the housing, either wires, metal strips or the like electrically connect the sockets to the flexible lead. However, the wiring of the sockets to the flexible lead is typically labour intensive, particularly when electrical wiring is used. The use of metal strips in the socket housing, rather than wiring, facilitates automated manufacture, but connection failures are still possible, particularly when subjected to mechanical shock or vibration during use and transportation of the multi-socket assemblies. While the term "multi-socket assembly" usually includes a plurality of sockets operatively connected to a plug, it is also taken herein to include such assemblies in which a single socket is operatively connected to a plug.

SUMMARY OF THE INVENTION

In accordance with the present invention, a multi-socket assembly is provided for enabling a plurality of outlets to be electrically connected to an inlet, particularly adapted for distributing AC current from said plug unit to said socket unit.

In a preferred embodiment, a multi-socket assembly is provided comprising a plug unit operatively connected to at least one socket unit and preferably a plurality of socket units, for example two socket units linearly arranged with the plug unit, characterized in that the assembly is formed as an integral body of at least one suitable electrically insulating material that encapsulates the electrical connections between said plug unit and the said at least one socket unit. The connections comprise a phase line, comprising electrically connected elements including a pin, conductor and at least one connector, and a neutral line, comprising electrically connected elements including a pin, conductor and at least one connector. Optionally, the electrical connections further comprise a ground line, comprising electrically connected elements including a pin, conductor and at least one connector. The earth line, phase line and neutral lines are each arranged along substantially parallel axes, and the earth line axis is in-between the phase line axis and the neutral line axis.

The plug unit and the socket units are preferably formed as blocks, formed as disks, cuboids or any other shape, interconnected via at least one of webs and bridges. Advantageously, another socket unit is provided, integrally formed with a block comprising said plug unit. Preferably, the bridges are of sufficient length such as to enable said at least one socket unit to be aligned over said plug unit to provide a compact configuration. The assembly preferably further comprises locking means to reversibly lock said at least one socket unit with respect to said plug unit when in said compact configuration. In the preferred embodiment, the locking means comprise mutually engageable male and female elements, each comprised on facing surfaces of said plug unit and said socket unit when in the said compact configuration.

The plug unit and socket units may be formed as blocks interconnected via at least one of webs and bridges, wherein a first encapsulating material is used for the blocks and a second encapsulating material is used for the bridges. The first encapsulating material may be relatively more rigid than the second encapsulating material.

The assembly may further comprise a suitable indicator for alerting a user that the said assembly is connected to an electric source. The indicator may comprise an LED that is adapted for lighting when said assembly is connected to an electric source.

The assembly may further comprise at least one switch for selectively connecting or interrupting the electrical connection between said plug unit and said at least one said socket unit.

The materials may include a suitable plastic or rubber-based material, and are also preferably flexible.

BRIEF DESCRIPTION OF THE DRAWINGS

In order to understand the invention and to see how it may be carried out in practice, a preferred embodiment will now be described, by way of non-limiting example only, with reference to the accompanying drawings, in which.

DETAILED DESCRIPTION OF THE INVENTION

Figure 1:
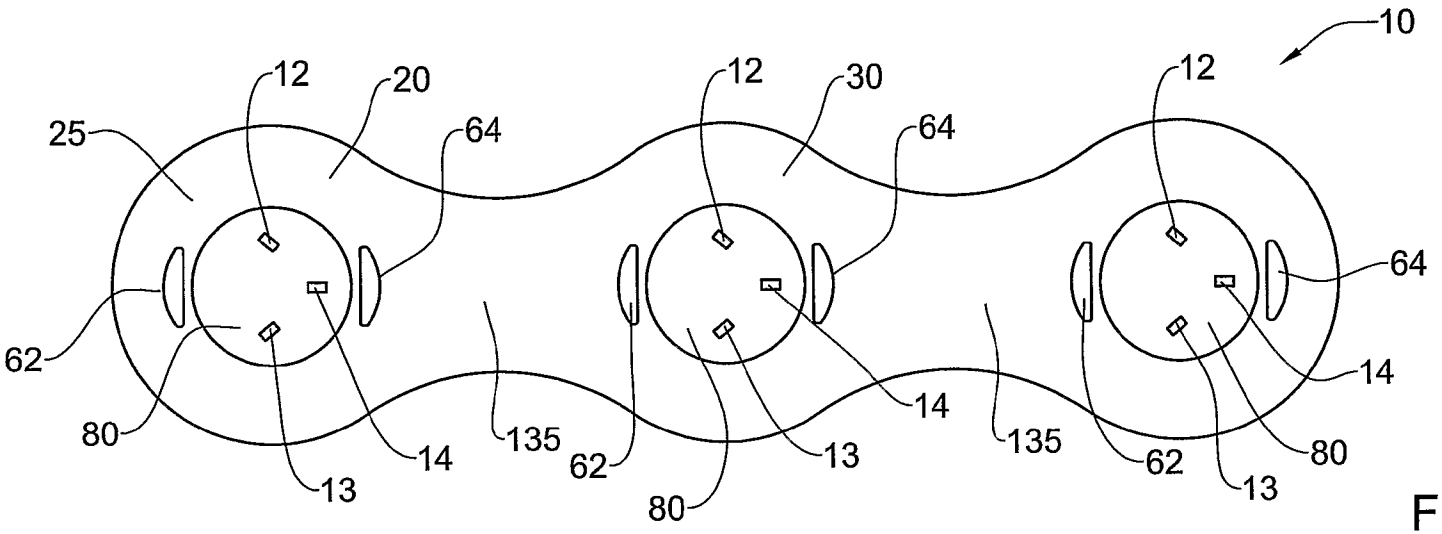
FIG. 1 is top view of the preferred embodiment of the invention.
Figure 2:
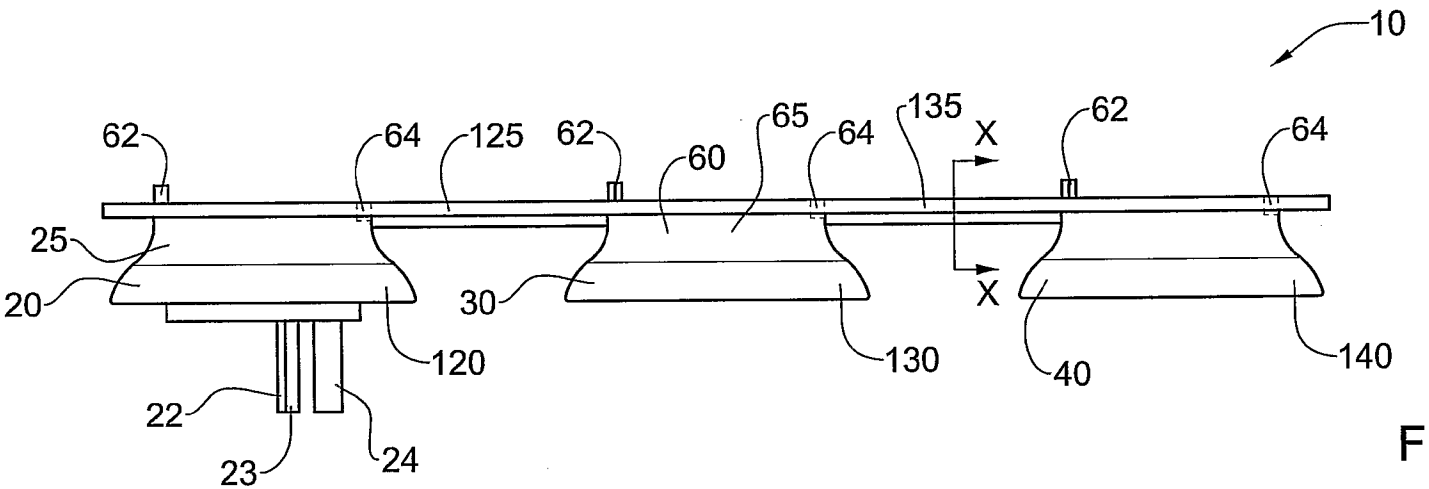
FIG. 2 is side view of the preferred embodiment of the invention.

With reference to FIGS. 1 and 2, a preferred embodiment of a multi-socket assembly according to the invention, herein designated with the numeral 10, is illustrated in plan view and side view, respectively, in accordance with Israeli Standards. The assembly 10 comprises one electrical polarized plug unit 20 at one end thereof, electrically connected to two polarized socket units 30, 40, which are arranged in series with the plug 20. Each socket unit comprises a phase (or "live") pin-hole 12, a neutral pin-hole 13, and a ground pin-hole 14. Optionally, the plug unit 20 may also comprise as an additional socket unit 25 integral therewith, which also comprises a phase pin-hole 12, a neutral pin-hole 13, and a ground pin-hole 14 on a side thereof opposed to the phase pin 22, neutral pin 23, and ground pin 24.

Figure 3:
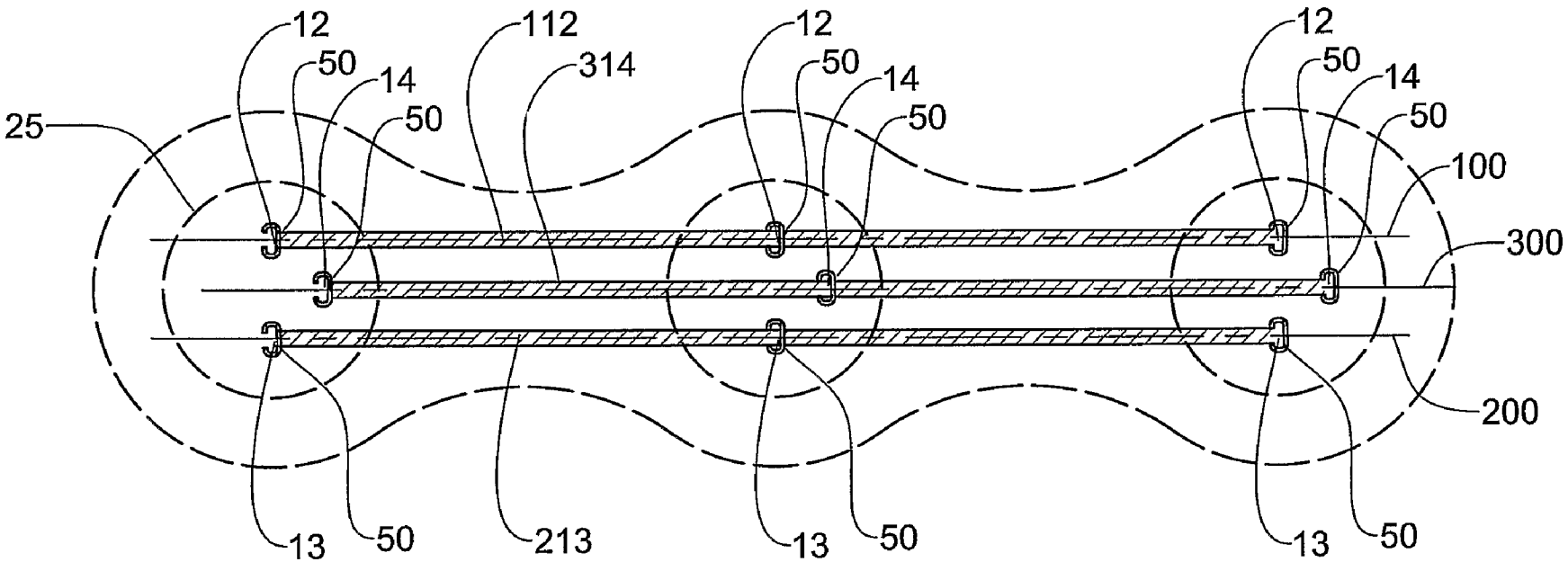
FIG. 3 illustrates the electrical connections of the embodiment of FIG. 1.

The electrical connection between the plug unit 20 and the socket units, 30, 40 (as well as the socket unit that is integral with the plug unit 20) is in parallel, as is the regular practice, but if required the electrical connection may be in series instead. Referring in particular to FIG. 3, the phase pin-holes 12 are mutually aligned along axis 100 and interconnected via electrical conductor 112. The neutral pin-holes 13 are mutually aligned along axis 200 and interconnected via electrical conductor 213. The ground pin holes 14 are mutually aligned along axis 300 and interconnected via electrical conductor 314. In this embodiment, the ground alignment axis 300 is arranged in-between the phase alignment axis 100 and the neutral alignment axis 200, which considerably facilitates the interconnections between the respective pin-holes. The conductors 112, 213 and 314 are typically in the form of metallic strips preferably integrally formed or alternatively welded to or otherwise connected to the appropriate pinhole connectors 50. The pinhole connectors 50 are preferably in the form of split cylinders, which may elastically deform outwardly when a pin from a plug is inserted therein, holding the same snugly to ensure a good electrical connection.

The assembly 10 is of integral construction, i.e., the pins 22, 23, 24, the connectors 50, and the conductors 112, 213, 314 are embedded in an integral body 65 of one or more non-electrically conducting encapsulating materials 60, such as for example a plastic or rubber material, of appropriate shape. This form of construction enables the multi-socket assembly 10 to be manufactured in a relatively simple manner and at low cost, since the connections between the pins, conductors and connectors for each of the ground, phase and neutral lines can be automated in a simple manner, and then the material 60 can be added, for example by casting in a mould suitably prepared with these electrical elements. This presents considerable advantages in simplicity, cost and assembly time over the prior art in which the electrical elements have to be accommodated into a socket box or the like.

Figure 4:
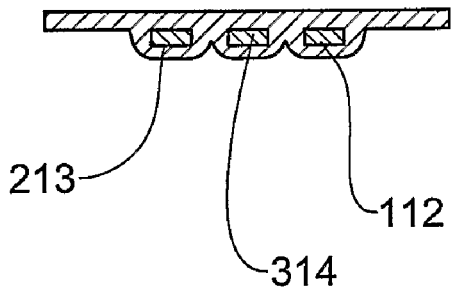
FIG. 4 is a cross sectional view of the embodiment of FIG. 2 taken along X-X
Figure 5:
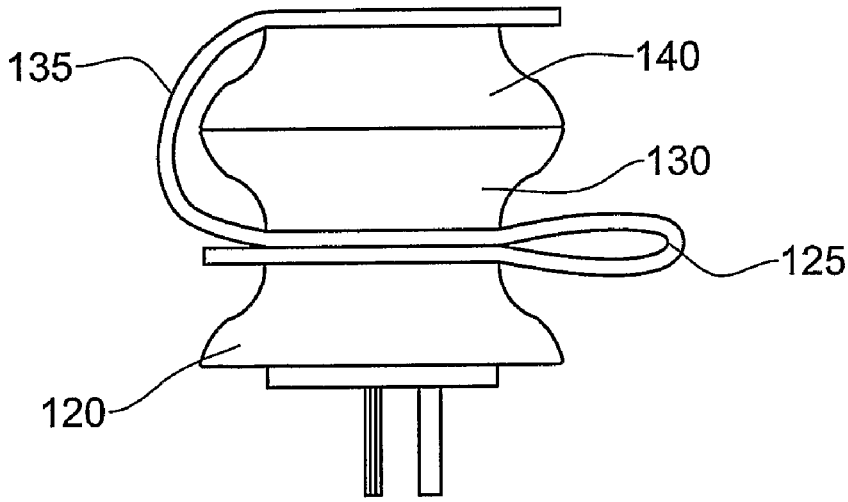
FIG. 5 is side view of the embodiment of FIG. 2 in compact configuration.
Figure 6:
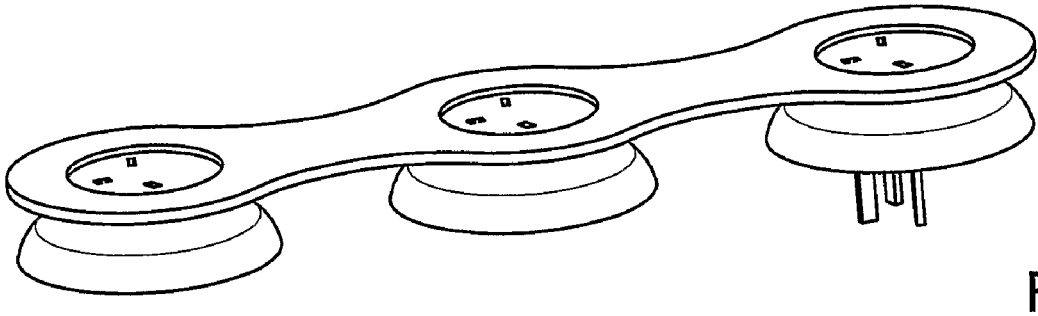
FIG. 6 is perspective view of the embodiment of FIG. 1.
Figure 7:
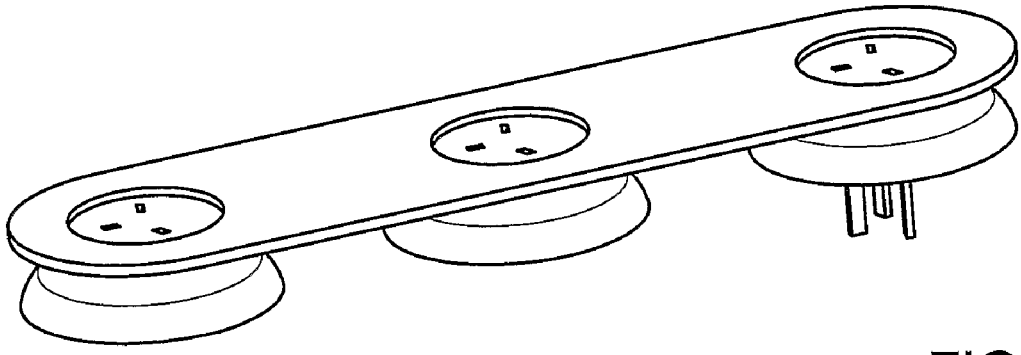
FIG. 7 is perspective view of a variation of the embodiment of FIG. 1.
Figure 8:
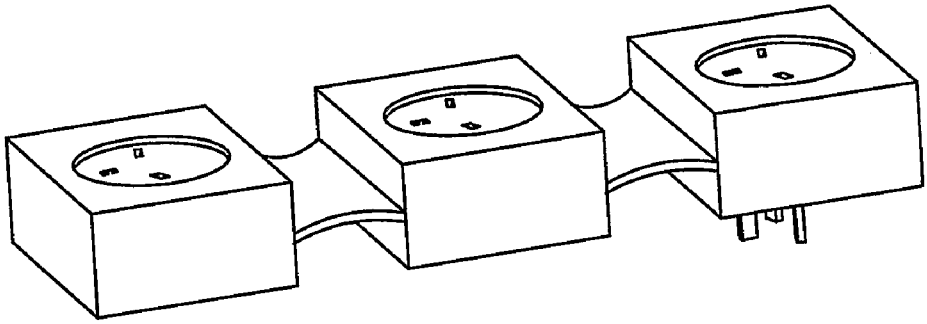
FIG. 8 is perspective view of another variation of the embodiment of FIG. 1.

In the preferred embodiment, the encapsulating material 60 is formed as a first block 120 comprising the plug unit 20 and socket unit 25, connected to a second block 130 comprising socket unit 30 via a bridge 125. The second block 130 is connected to a third block 140 comprising socket unit 40 via bridge 135. In some embodiments the blocks 120, 130, 140 and the bridges 125, 135 are made from the same material. Alternatively, the blocks 120, 130, 140 may be made from one type of material, for example a relatively hard material, and the bridges 125, 135 from a flexible material, and both materials poured into mould for assembly 10 at the same time. Such is procedure is known, and referred to as "co-molding", wherein the different encapsulating materials 60 form a single integral body. The blocks 120, 130, 140 are typically disc-like, and may be further contoured in an appropriate manner to facilitate handling and manipulation thereof with the fingers, as illustrated in FIGS. 1, 2 and 6. Alternatively, the blocks 120, 130, 140 may be formed as cuboids, as illustrated in FIG. 8 for example or indeed any suitable shape. Optionally, wings (not shown) may be provided on either side of the blocks, for example, for further facilitating this activity. The material 60 is typically flexible, allowing considerable relative movement between the blocks 120, 130, 140, particularly via bridges 125, 135, as these are typically formed as thin strips of material in which the conductors 213, 314, 112 are encased (see FIG. 4). The bridges may be formed as waisted strips, as illustrated in FIG. 6 or alternatively as having parallel borders, as illustrated in FIG. 7, for example. Advantageously, the bridges 125, 135 are of sufficient length along the axes 100, 200, 300 such as to enable the blocks 120, 130, 140 to be aligned one over the other, as illustrated in FIG. 5. This provides a compact configuration for the multi-socket assembly 10, which is advantageous when storing the same or when traveling, for example. Particularly for use in the compact configuration, the multi-socket assembly 10 further comprises locking means for releasably retaining the blocks 120, 130, 140 in the compact configuration. For example, the locking means may comprise pieces of magnetised material embedded on facing surfaces of the blocks 120, 130, 140, such as to expose a North or South pole on these faces. The polarity of the exposed parts of the pieces is such that when the multi-socket assembly 10 is in the compact configuration, magnetised pieces having opposite poles are aligned and brought into contact, and the resulting magnetic attraction force keeps the assembly 10 in the compact configuration until it is prised apart by the user. Alternatively, and as illustrated in FIGS. 1 and 2, the locking means may be in the form of interlocking male elements 62 and female elements 64 comprised on facing surfaces of the blocks 120, 130, 140. The male elements 62 may comprise, for example, a projection of material 60, made integrally with the rest of the assembly 10, and adapted for releasable press-fitting with respect to a female element 64, in the form of a complementarily shaped well. Optionally, the male elements 62 and/or the female elements 64 may comprise surface features such as ribs or nodes (not shown) to improve the locking characteristics between the male and female elements.

Advantageously, the upper faces 80 of the socket units 25, 30, 40 comprise a thin skin of material 60 extending over each of the pin holes 12, 13, 14 comprised therein. This skin is split so as to allow entry of an appropriate pin, 22, 23, 24 via the same and into the appropriate connector 50, when the pin is forced into the appropriate pin hole. At the same time, when the pin is removed, the skin covers the pin hole and helps to keep foreign material from the pinhole, including moisture, at least to some extent.

Optionally, a suitable indicator, such as an LED for example (not shown) may be provided for alerting a user that the assembly 10 is connected to an electric mains.

Optionally, the assembly 10 may further comprise at least one switch (not shown) externally mounted to the plug and/or socket blocks. In applications where a single switch is provided, this may be advantageously mounted onto the plug unit 20 for selectively connecting or interrupting the electrical connection to all of the socket units 30, 40. In other applications, a switch may be provided for each socket unit 30, 40 for selectively connecting or interrupting the electrical connection to each socket unit independently of the other socket units. Optionally, the switch may comprise a suitable indicator, such as an LED for example (not shown) or may be formed in clear plastic and comprise an internal light, for alerting a user whenever the assembly 10 is connected to an electric mains.

Figure 9:
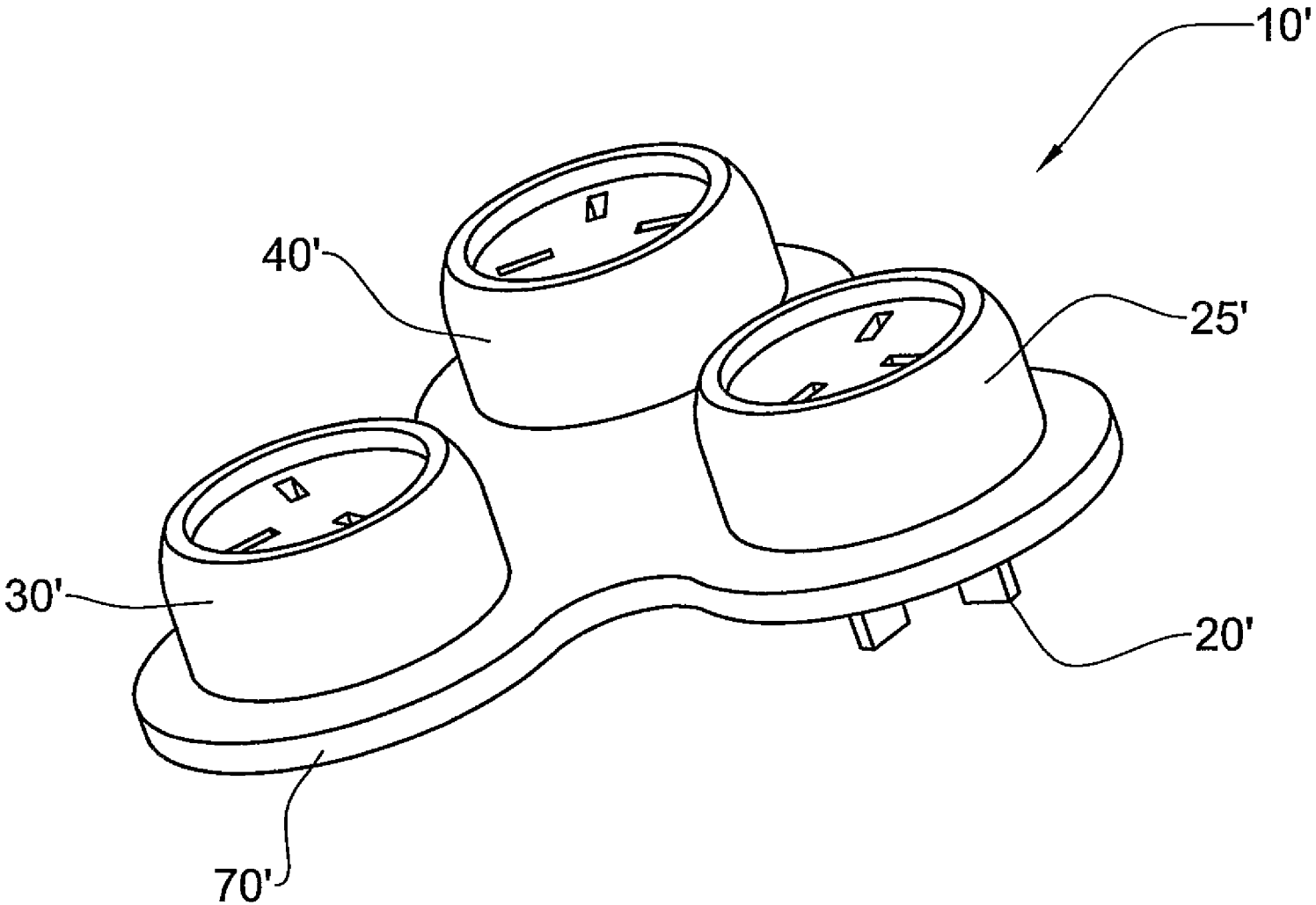
FIG. 9 is perspective view of another embodiment of the present invention.

It will be appreciated that an assembly as described with three socket units in linear arrangement is only an example, and that any number of socket units (including a single socket unit), and of any desired shape, may be included in such an assembly. Furthermore, in such cases, the socket units may be arranged in series or in the form of an array or in any other desired arrangement, and the plug unit may be provided wherever convenient with respect to the arrangement. For example, as illustrated in FIG. 9, three socket units 25', 30', 40' are arranged in a triangle, joined together via a preferably flexible web 70' of material, and the socket unit 25' also comprises a polarized plug 20' integral therewith. The multi-socket assembly 10' of FIG. 9 is also of integral construction, wherein the electrical connections along each of the phase line and the neutral line, and where applicable also along the earth line, are established, and then a suitable material is cast or otherwise formed over the electrical connections as described for the preferred embodiment, mutatis mutandis. In other embodiments, both webs and bridges may be provided for interconnecting the blocks.

While the multi-socket assembly has been described in relation to Israeli Standards, it should be noted that by obvious modifications the assembly may be adopted to other standards such as for example, British Standards or American Standards. Furthermore, it is also possible to modify the assembly to comprise only the phase line elements and the neutral line elements, that is, without the earth line elements.

Further, while the preferred embodiment has been described with reference to a multi-socket assembly for use as an electric extension device, many other applications of the assembly are possible. For example, the assembly may be adapted for enabling the connection of several speakers to a home entertainment unit, such as a TV or CD player, in which the inlet is adapted for connection to the audio output channel of the home entertainment system, and the plurality of outlets are each adapted for enabling a speaker jack to be connected thereto. In another example, the device is adapted for enabling the connection of several telephone jacks to be connected to the one communication output via a common jack (or "plug").

The invention claimed is:

1. A multi-socket assembly formed as a unitary, integrally molded body comprising:

a plug unit integrally formed with a first socket unit and at least one additional socket unit electrically connected to the plug unit, each being formed as blocks interconnected by a flexible bridge;

electrically insulating material encapsulating at least two parallelly spaced apart electrical connections between said plug unit and said socket units;

said electrical connections comprise a phase line, comprising electrically connected elements including a pin, conductor and at least one connector, and a neutral line, comprising electrically connected elements including a pin, conductor and at least one connector; and the flexible bridge being of sufficient length to enable folding thereof so as to provide a compact configuration, whereby said at least one additional socket unit is aligned over said plug unit.

2. An assembly according to claim 1, wherein said blocks are formed as discs.

3. An assembly according to claim 1, comprising two said socket units linearly arranged with respect to said plug unit.

4. An assembly according to claim 1, further comprising a suitable indicator for alerting a user that the said assembly is connected to an electric source.

5. An assembly according to claim 1, wherein said indicator comprises an LED that is adapted for lighting when said assembly is connected to an electric source.

6. An assembly according to claim 1, further comprising at least one switch for selectively connecting or interrupting the electrical connection between said plug unit and said at least one said socket unit.

7. An assembly according to claim 1, particularly adapted for distributing AC current from said plug unit to said socket units.

8. An assembly according to claim 1, wherein said electrical connections further comprise a ground line, comprising electrically connected elements including a pin, conductor and at least one connector.

9. An assembly according to claim 8, wherein said earth line, phase line and neutral lines are each arranged along substantially parallel axes, and wherein the earth line axis is in-between the phase line axis and the neutral line axis.

10. An assembly according to claim 1, further comprising locking means to reversibly lock said at least one socket unit with respect to said plug unit when in said compact configuration.

11. An assembly according to claim 10, wherein said locking means comprise mutually engageable male and female elements, each comprised on facing surfaces of said plug unit and said socket unit when in the said compact configuration.

12. An assembly according to claim 1, wherein said material is a suitable plastic or rubber-based material.

13. An assembly according to claim 12, wherein said material is a flexible material.

14. An assembly as claimed in claim 1 wherein said integral body is formed by casting said at least one encapsulating material in a suitable mold.

15. An assembly according to claim 14, wherein said plug unit and said socket units are formed as blocks interconnected via at least one of webs and bridges, and wherein a first encapsulating material is used for said blocks and a second encapsulating material is used for said bridges.

16. An assembly according to claim 15, wherein said first encapsulating material is relatively more rigid than said second encapsulating material.

17. A multi-socket assembly formed as a unitary, integrally molded body comprising:

a plug unit integrally formed with a first socket unit and at least one additional socket unit electrically connected to the plug unit, each being formed as blocks interconnected by a flexible bridge;

electrically insulating material encapsulating at least two parallelly spaced apart electrical connections between said plug unit and said socket units;

the flexible bridge being of sufficient length to enable folding thereof so as to provide a compact configuration, whereby said at least one additional socket unit is aligned over said plug unit; and at least one locking element to reversibly lock said at least one socket unit with respect to said plug unit when in said compact configuration.

18. An assembly according to claim 17, wherein said locking element comprises mutually engageable male and female elements, each formed on facing surfaces of said plug unit and said socket unit when in said compact configuration.

* * * * *